US010660399B2

(12) United States Patent
Torrance et al.

(10) Patent No.: US 10,660,399 B2
(45) Date of Patent: May 26, 2020

(54) FLEXIBLE SHOE SOLE

(75) Inventors: Tony L. Torrance, Boulder, CO (US); Philip Majure, Louisville, CO (US)

(73) Assignee: DASHAMERICA, INC., Louisville, CO (US)

( * ) Notice: Subject to any disclaimer, the term of this patent is extended or adjusted under 35 U.S.C. 154(b) by 916 days.

(21) Appl. No.: 14/006,145

(22) PCT Filed: Mar. 23, 2012

(86) PCT No.: PCT/US2012/030308

§ 371 (c)(1),
(2), (4) Date: Nov. 25, 2013

(87) PCT Pub. No.: WO2012/135007

PCT Pub. Date: Oct. 4, 2012

(65) Prior Publication Data

US 2014/0068880 A1 Mar. 13, 2014

Related U.S. Application Data

(60) Provisional application No. 61/467,807, filed on Mar. 25, 2011.

(51) Int. Cl.

| | |
|---|---|
| ***A43B 13/14*** | (2006.01) |
| ***A43B 13/02*** | (2006.01) |
| ***A43B 5/14*** | (2006.01) |

(52) U.S. Cl.

CPC ..... *A43B 13/14* (2013.01); *A43B 5/14* (2013.01); *A43B 13/026* (2013.01); *A43B 13/141* (2013.01)

(58) Field of Classification Search

CPC ..... A43B 13/12; A43B 13/122; A43B 13/04; A43B 7/142; A43B 7/144; A43B 7/1445;

(Continued)

(56) References Cited

U.S. PATENT DOCUMENTS

| | | | |
|---|---|---|---|
| 1,923,169 | A | 8/1933 | Simmons |
| 2,376,854 | A | 5/1945 | Saunders et al. |

(Continued)

FOREIGN PATENT DOCUMENTS

| | | |
|---|---|---|
| EP | 0272082 | 6/1988 |
| EP | 0726037 | 8/1996 |

(Continued)

OTHER PUBLICATIONS

U.S. Appl. No. 10/631,572, filed Jul. 30, 2003 now U.S. Pat. No. 6,922,917.

(Continued)

*Primary Examiner* — Alissa J Tompkins
*Assistant Examiner* — Catherine M Ferreira
(74) *Attorney, Agent, or Firm* — Jeffer Butler Mangels & Mitchell LLP; Brennan C. Swain, Esq.

(57) ABSTRACT

Embodiments of the present invention generally relate to a composite element adapted for use with an article of footwear. The composite element generally comprises a first portion with a first rigidity and a second portion with a second, different rigidity. The first portion and the second portion each comprise at least one fiber-reinforced layer and are configured to provide the desired rigidity characteristics according to a wearer's characteristics and/or an intended use of the footwear.

18 Claims, 6 Drawing Sheets

(58) Field of Classification Search
CPC ..... A43B 13/20; A43B 13/26; A43B 7/32; A43B 7/143; A43B 13/206; A43B 13/22; A43B 3/108; A43B 13/026; A43B 7/141; A43B 7/1425; A43B 13/14; A43B 5/14; A43B 13/141; B29C 66/71; B29C 66/7212; B29C 2793/009; B29C 65/18; B29C 66/0342; B29C 66/7392; B29C 66/7394; B29C 66/8161; B29C 2035/0827; B29C 33/0055; B29C 33/58; B29C 33/64; B29C 37/0067; B29C 37/0075
USPC ..... 36/28, 103, 31; 12/146 B
See application file for complete search history.

(56) References Cited

U.S. PATENT DOCUMENTS 3,310,889 A 3/1967 Samuels
3,522,669 A 8/1970 Simons
4,316,334 A * 2/1982 Hunt ..... A43B 7/142 36/154
4,445,286 A 5/1984 Norton
D288,027 S 2/1987 Tonkel
4,651,445 A 3/1987 Ahannibal
4,694,589 A 9/1987 Sullivan et al.
4,833,796 A 5/1989 Flemming
4,845,864 A 7/1989 Corliss
D303,451 S 9/1989 Weiner
4,876,808 A * 10/1989 Hsieh ..... A43B 5/14 36/131
4,910,883 A 3/1990 Zock
4,918,838 A 4/1990 Chang
4,942,677 A 7/1990 Flemming et al.
5,035,069 A 7/1991 Minden
5,052,130 A 10/1991 Barry et al.
5,086,576 A 2/1992 Lamson
5,117,567 A 6/1992 Berger
5,154,682 A 10/1992 Kellerman
5,177,882 A 1/1993 Berger
5,179,791 A 1/1993 Lain
5,199,192 A * 4/1993 Kilgore ..... A43B 5/14 36/131
5,337,492 A 8/1994 Anderie et al.
5,406,723 A 4/1995 Okajima
5,461,800 A 10/1995 Luthi et al.
5,511,325 A 4/1996 Heiblinger
5,628,129 A 5/1997 Kilgore et al.
5,636,456 A 6/1997 Allen
5,678,327 A 10/1997 Halberstadt
D387,890 S 12/1997 Faulconer et al.
5,709,954 A 1/1998 Lyden et al.
D390,348 S 2/1998 Meyer et al.
5,737,854 A 4/1998 Sussmann
5,761,831 A 6/1998 Cho
5,832,634 A * 11/1998 Wong ..... A43B 13/026 36/107
5,836,094 A 11/1998 Figel
5,897,515 A 4/1999 Willner et al.
D409,362 S 5/1999 Turner et al.
D412,612 S 8/1999 Boyer
5,934,599 A 8/1999 Hammerslag
5,940,994 A 8/1999 Allen
D417,943 S 12/1999 Solaroli
6,006,449 A 12/1999 Orlowski et al.
6,009,641 A 1/2000 Ryan
6,076,283 A 6/2000 Boie
6,079,125 A 6/2000 Quellais et al.
D428,238 S 7/2000 Price
D432,294 S 10/2000 Wilson
6,145,221 A 11/2000 Hockerson
6,289,558 B1 9/2001 Hammerslag
D456,982 S 5/2002 Rogers
D460,853 S 7/2002 Sakai
6,477,793 B1 11/2002 Pruitt et al.
6,505,424 B2 1/2003 Oorei et al.
D473,698 S 4/2003 St-Louis
6,574,889 B2 6/2003 Cagner
6,601,042 B1 7/2003 Lyden
D484,674 S 1/2004 Issler
D487,184 S 3/2004 Issler
6,726,985 B2 4/2004 Amitai et al.
D490,220 S 5/2004 Edauw
6,742,286 B2 6/2004 Giovale
D493,951 S 8/2004 Adams et al.
6,775,930 B2 * 8/2004 Fuerst ..... A43B 13/026 12/146 B
6,782,639 B1 8/2004 Muller
D496,779 S 10/2004 Belley et al.
D499,534 S 12/2004 McClaskie
D501,294 S 2/2005 Robbins et al.
D504,007 S 4/2005 Cintron
D507,096 S 7/2005 Chen
D508,160 S 8/2005 Sonnergren
D508,307 S 8/2005 Burg et al.
6,922,917 B2 8/2005 Kerns et al.
6,948,262 B2 9/2005 Kerrigan
6,948,264 B1 9/2005 Lyden
D514,288 S 2/2006 Burg
7,016,867 B2 3/2006 Lyden
7,076,892 B2 7/2006 Meschan
7,096,605 B1 8/2006 Kozo et al.
7,100,309 B2 9/2006 Smith et al.
7,107,235 B2 9/2006 Lyden
D532,585 S 11/2006 McDonald
D536,517 S 2/2007 Gerber
D541,019 S 4/2007 McClaskie
D543,340 S 5/2007 Favreau et al.
7,219,450 B2 5/2007 Langley
D546,532 S 7/2007 Matis et al.
7,290,357 B2 11/2007 McDonald et al.
D556,980 S 12/2007 Bramani
7,334,351 B2 2/2008 Hann
D566,935 S 4/2008 Matis et al.
D566,938 S 4/2008 Matis et al.
7,377,057 B2 5/2008 Lacorazza et al.
7,383,647 B2 6/2008 Chan et al.
7,401,421 B2 * 7/2008 Brennan ..... A43B 13/026 36/107
7,401,424 B2 7/2008 Kerns et al.
D574,130 S 8/2008 Le
D575,040 S 8/2008 Bramani
D586,991 S 2/2009 Fuerst
7,487,604 B2 2/2009 Perron, Jr.
7,533,480 B2 5/2009 Chao et al.
D593,740 S 6/2009 McClaskie
D594,195 S 6/2009 Nakano
D596,385 S 7/2009 McDade et al.
D602,237 S 10/2009 Roundhouse
D602,683 S 10/2009 Roundhouse
7,762,008 B1 7/2010 Clark et al.
7,779,557 B2 8/2010 Teteriatnikov
7,814,683 B2 10/2010 Lee
D632,879 S 2/2011 Merkazy et al.
7,877,897 B2 2/2011 Teteriatnikov
7,941,941 B2 5/2011 Hazenberg et al.
7,946,058 B2 5/2011 Johnson et al.
7,946,060 B2 * 5/2011 Rosenbaum ..... A43B 13/141 36/28
8,082,684 B2 12/2011 Munns
D657,941 S 4/2012 Bramani et al.
D659,361 S 5/2012 Jolicoeur
8,166,672 B2 * 5/2012 Murphy ..... A43B 13/141 36/103
D671,301 S 11/2012 Dombrow
D676,224 S 2/2013 Marshall
D683,117 S 5/2013 Truelsen
D693,101 S 11/2013 Dombrow
D695,505 S 12/2013 Hansen
D697,296 S 1/2014 Loyley
8,621,767 B2 1/2014 Vestuti et al.
8,631,590 B2 1/2014 Droege et al.
8,776,397 B2 * 7/2014 Borel ..... A43B 13/026 36/103

(56) References Cited

U.S. PATENT DOCUMENTS

| | | | | |
|---|---|---|---|---|
| 2001/0022041 | A1 | 9/2001 | Gebhard | |
| 2002/0062578 | A1 | 5/2002 | Lussier et al. | |
| 2002/0144429 | A1 | 10/2002 | Hay | |
| 2003/0051574 | A1 | 3/2003 | Muraoka | |
| 2003/0088996 | A1 | 5/2003 | Hall | |
| 2004/0068891 | A1 | 4/2004 | Wang | |
| 2004/0107601 | A1 | 6/2004 | Schmid | |
| 2004/0153168 | A1 | 8/2004 | Childress et al. | |
| 2005/0016028 | A1 | 1/2005 | Safdeye | |
| 2005/0060909 | A1 | 3/2005 | Kerns et al. | |
| 2005/0166422 | A1 | 8/2005 | Schaeffer et al. | |
| 2005/0198866 | A1 | 9/2005 | Wiper et al. | |
| 2005/0198868 | A1 | 9/2005 | Scholz | |
| 2005/0210712 | A1* | 9/2005 | Jau | A43B 5/14 36/131 |
| 2007/0039208 | A1 | 2/2007 | Bove et al. | |
| 2007/0039209 | A1 | 2/2007 | White et al. | |
| 2007/0180632 | A1* | 8/2007 | Gallegos | A43B 1/0054 12/146 B |
| 2008/0016724 | A1 | 1/2008 | Hlavac | |
| 2008/0034615 | A1 | 2/2008 | Nishiwaki et al. | |
| 2008/0163513 | A1 | 7/2008 | Chapman | |
| 2008/0216355 | A1 | 9/2008 | Becker et al. | |
| 2008/0276496 | A1 | 11/2008 | Kerns | |
| 2008/0289220 | A1 | 11/2008 | Rivas et al. | |
| 2009/0019730 | A1 | 1/2009 | Salminen et al. | |
| 2009/0084000 | A1 | 4/2009 | Pai | |
| 2009/0113757 | A1 | 5/2009 | Banik | |
| 2009/0172971 | A1 | 7/2009 | Peikert et al. | |
| 2009/0178303 | A1 | 7/2009 | Hurd et al. | |
| 2009/0183393 | A1 | 7/2009 | Lee | |
| 2009/0211115 | A1 | 8/2009 | Geer | |
| 2009/0249656 | A1 | 10/2009 | Shelton et al. | |
| 2009/0313856 | A1 | 12/2009 | Arizumi | |
| 2010/0050475 | A1* | 3/2010 | Benz | A43B 5/02 36/103 |
| 2010/0122471 | A1 | 5/2010 | Edington et al. | |
| 2010/0192421 | A1 | 8/2010 | Kerns et al. | |
| 2010/0293811 | A1 | 11/2010 | Truelsen | |
| 2011/0035960 | A1 | 2/2011 | Werremeyer | |
| 2011/0047816 | A1 | 3/2011 | Nurse | |
| 2011/0138652 | A1 | 6/2011 | Lucas et al. | |
| 2011/0138658 | A1 | 6/2011 | Ueda et al. | |
| 2011/0185590 | A1 | 8/2011 | Nishiwaki et al. | |
| 2011/0197469 | A1 | 8/2011 | Nishiwaki et al. | |
| 2011/0214313 | A1 | 9/2011 | James et al. | |
| 2012/0000095 | A1 | 1/2012 | Torrance | |
| 2013/0152428 | A1 | 6/2013 | Bishop et al. | |
| 2014/0013626 | A1 | 1/2014 | James et al. | |

FOREIGN PATENT DOCUMENTS

| | | |
|---|---|---|
| EP | 1832191 | 9/2007 |
| EP | 1832192 | 9/2007 |
| FR | 2775424 | 9/1999 |
| GB | 2256784 | 12/1992 |
| JP | H04-327801 | 11/1992 |
| JP | H05-76304 | 10/1993 |
| JP | H07-308205 | 11/1995 |
| JP | H09-10003 | 1/1997 |
| JP | 2000-125905 | 5/2000 |
| WO | WO 96/00512 | 1/1996 |
| WO | WO 03/002042 | 1/2003 |
| WO | WO 2004/113058 | 12/2004 |
| WO | WO 2010/051657 | 5/2010 |

OTHER PUBLICATIONS

U.S. Appl. No. 11/070,579, filed Mar. 1, 2005.
U.S. Appl. No. 10/710,476, filed Jul. 14, 2004 now U.S. Pat. No. 7,401,424.
U.S. Appl. No. 12/176,883, filed Jul. 21, 2008.
U.S. Appl. No. 12/697,206, filed Jan. 29, 2010.
U.S. Appl. No. 13/163,647, filed Jun. 17, 2011.
U.S. Appl. No. 29/428,044, filed Jul. 25, 2012.
U.S. Appl. No. 29/428,045, filed Jul. 25, 2012.
U.S. Appl. No. 29/428,047, filed Jul. 25, 2012.
U.S. Appl. No. 29/428,049, filed Jul. 25, 2012.
U.S. Appl. No. 29/428,051, filed Jul. 25, 2012.
U.S. Appl. No. 29/428,052, filed Jul. 25, 2012.
Official Action for Canada Patent Application No. 2,830,641, dated Jul. 8, 2015 4 pages.
Official Action with English Translation for Japan Patent Application No. 2014-501269, dated Jul. 28, 2015 8 pages.
Examination Report for Australia Patent Application No. 2012236934, dated Nov. 8, 2014 3 pages.
Extended Search Report for European Patent Application No. 12762931.9, dated Oct. 15, 2014 8 pages.
U.S. Appl. No. 29/428,044, filed Jul. 25, 2012, Tucker et al.
U.S. Appl. No. 29/428,045, filed Jul. 25, 2012, Tucker et al.
U.S. Appl. No. 29/428,047, filed Jul. 25, 2012, Tucker et al.
U.S. Appl. No. 29/428,049, filed Jul. 25, 2012, Tucker et al.
U.S. Appl. No. 29/428,051, filed Jul. 25, 2012, Tucker et al.
U.S. Appl. No. 29/428,052, filed Jul. 25, 2012, Tucker et al.
International Search Report and Written Opinion for International (PCT) Patent Application No. PCT/US2012/030308 dated Jun. 20, 2012, 12 pages.
"Carbon (fiber)," Wikipedia, the free encyclopedia, 2010, [retrieved on Feb. 27, 2011], 5 pages. Retrieved from: http://en.wikipedia.org/wiki/Carbon_(fiber).
"Carbon fiber-reinforced polymer," Wikipedia, the free encyclopedia, 2011, [retrieved on Feb. 27, 2011], 7 pages. Retrieved from: http://en.wikipedia.org/wiki/Carbon_fiber-reinforced_polymer.
"Composite material," Wikipedia, the free encyclopedia, 2011, [retrieved on Feb. 26, 2011], 10 pages. Retrieved from: http://en.wikipedia.org/wiki/Composite_material.
"Deformation (mechanics)," Wikipedia, the free encyclopedia, 2011, [retrieved on Feb. 27, 2011], 14 pages. Retrieved from: http://en.wikipedia.org/wiki/Deformation_(mechanics).
"Pre-preg," Wikipedia, the free encyclopedia, 2011 [retrieved on Sep. 25, 2013], 2 pages. Retrieved from: http://en.wikipedia.org/w/index.php?title=Pre-preg&direction=prev&oldid=406926465.
CA2830641 Examiner's Action.
U.S. Appl. No. 13/970,274, filed Aug. 19, 2013, Tucker et al.
International Preliminary Report on Patentability for International (PCT) Patent Application No. PCT/US2012/030308 dated Nov. 28, 2013, 11 pages.
Dugan et al., "Biomechanics and Analysis of Running Gait," Physical Medicine and Rehabilitation Clinics of North America, 2005, vol. 16, No. 3, pp. 603-621.
Official Action for New Zealand Patent Application No. 615650 dated May 1, 2014, 2 pages.
Official Action for Canadian Patent Application No. 2,830,641, dated Jan. 27, 2015, 4 pages.

* cited by examiner

FLEXIBLE SHOE SOLE

CROSS REFERENCE TO RELATED APPLICATION

This application is a national stage application under 35 U.S.C. § 371 of PCT Application No. PCT/US2012/030308 having an international filing date of Mar. 23, 2012, which designated the United States, which PCT application claimed the benefit of U.S. Provisional Patent Application No. 61/467,807, filed on Mar. 25, 2011, both of which are incorporated by reference in their entirety.

The present application claims the benefit of U.S. Provisional Application No. 61/467,807, filed Mar. 25, 2011, the entire contents of which are hereby incorporated herein by this reference.

FIELD OF THE INVENTION

This disclosure relates generally to a sole for footwear and, more particularly, to a composite element for footwear and a method for making the same.

BACKGROUND

People need different amounts of support for their footwear depending on their characteristics, such as weight and gait, and upon the intended use of the footwear. For example, in some situations, such as during cross-training, it may be beneficial to have longitudinal and lateral support in the footwear. Alternatively, in some situations, such as sprinting, it may be beneficial to have longitudinal support, but not lateral support.

In addition to providing footwear that meets a wearer's support needs, the footwear needs to provide maximum performance and maintain comfort, efficiently transferring energy and providing flexibility. Furthermore, footwear needs to be lightweight and durable. For example, a bicyclist needs footwear that provides adequate support in the area surrounding the ball of the foot to reduce foot fatigue and provide flexibility both while bicycling and when dismounted from the bicycle. Additionally, the footwear needs to be lightweight and have the ability to flex according to the flexure of the wearer's foot.

Thus, there is a need for a sole support system that provides a wearer with the desired flexure characteristics while maintaining the desired level of performance and support.

SUMMARY

These and other needs are addressed by the various aspects, embodiments, and configurations of the present disclosure. This disclosure relates generally to footwear, more particularly to a footwear sole, and even more particularly to a footwear composite element and a method of manufacturing the same.

Embodiments of the present disclosure generally relate to footwear utilizing a composite element with tuned rigidity. In one embodiment, an article of footwear includes a sole attached to a shoe upper. Some embodiments of the invention are a midsole, an outsole or an innersole of an article of footwear, comprising a composite element of the invention. Another embodiment of the invention is an article of footwear comprising a midsole, an outsole or an innersole comprising a composite element of the invention. Another embodiment of the invention is an article of footwear comprising a midsole, an outsole and an innersole, each comprising a composite element of the invention.

In one embodiment, the first portion is positioned in a first region of a composite element, and the second portion is positioned in a second, different region of the composite element. In another embodiment, the first portion and the second portion are at least partially disposed within the same region of the composite element. In one embodiment, a composite element comprises a toe region, a forefoot region, an arch region, a heel region, or any combination thereof. In one embodiment, a composite element includes a first portion having a first rigidity and a second portion having a second rigidity that is different than the first rigidity. The first portion and the second portion of the composite element may be formed in various shapes. For example, in one embodiment, the first portion and/or the second portion is circular, rectangular, triangular, or u-shaped when viewed from a proximal viewpoint. Further, the first portion and/or the second portion may be formed in various sizes. For example, in one embodiment, the first portion and/or the second portion extend approximately a full width of a sole. In another embodiment, a more rigid portion extends a partial width of a shoe sole. In this embodiment, a less rigid portion may surround the sides of the more rigid portion when viewed from a proximal viewpoint. In yet another embodiment, the first portion has a different thickness than the second portion. Moreover, the first portion and/or the second portion may be positioned in various regions within a composite element.

In one embodiment, a composite element includes a deformable portion and a substantially non-deformable portion. In one embodiment, the deformable portion comprises at least one fiber-reinforced layer, and the substantially non-deformable portion comprises at least one fiber-reinforced layer. In one embodiment, the deformable portion comprises a different number of layers than the substantially non-deformable portion. In one embodiment, the deformable portion and the substantially non-deformable portion each comprise a plurality of fiber-reinforced layers configured to provide a footwear sole with the desired flexure characteristics according to the characteristics of the wearer and the intended use. The orientation, the shape, the thickness, and/or the number of layers, for example, of each portion may be altered to provide the desired flexure characteristics for that portion of the composite element.

In one embodiment, a composite element has at least one deformable toe region, arch region, and heel region having a first plurality of fiber-reinforced layers, and a substantially non-deformable forefoot region having a second plurality of fiber-reinforced layers. The forefoot region generally is positioned between the toe region and the arch region, and the arch region generally is positioned between the forefoot region and the heel region. The second plurality of fiber-reinforced layers may have a greater number of layers than the first plurality of fiber-reinforced layers. The first and second pluralities of fiber-reinforced layers may form the composite element.

In one embodiment, an outsole may include at least one lug protruding distally from the outsole. The lug(s) may be an integral component of the outsole, or, alternatively, the lug(s) may be a separate component attached to the outsole. In addition, the position and composition of the lug(s) may vary. In yet another embodiment, an outsole may include a cleat attachment void, cut or drilled into the outsole to accommodate the attachment of a cleat.

In another embodiment, a method of manufacturing a composite element is provided. The method comprises:

providing one or more sole prepreg layers, each sole layer having a forefoot region and at least one of a toe, arch and heel region, wherein the forefoot region is positioned between the toe and arch region and the arch region is located between the forefoot and heel regions; providing one or more forefoot prepreg layers; positioning, in a first mold, the one or more sole prepreg layers and the one or more forefoot layers one on top of another to form a first assembly having each of the forefoot prepreg layers positioned about the forefoot region of the one or more sole prepreg layers; and applying one or both of heat and pressure to the first assembly to form a composite.

Additionally, the method may further comprise molding the composite element with an outsole element to form an outsole, a midsole element to form a midsole, and an innersole element to form an innersole. Moreover, the method may comprise bonding the sole to a shoe upper.

The foregoing and other objectives, features, and advantages of embodiments of the disclosure will be more readily understood upon consideration of the following detailed description, taken in conjunction with the accompanying drawings.

The preceding is a simplified summary to provide an understanding of some aspects of the disclosure. This summary is neither an extensive nor exhaustive overview of various embodiments of the present disclosure. It is intended neither to identify key or critical elements of the disclosure nor to delineate the scope of the disclosure but to present selected concepts of the disclosure in a simplified form as an introduction to the more detailed description presented below. As will be appreciated, other embodiments are possible utilizing, alone or in combination, one or more of the features set forth above or described in detail below.

BRIEF DESCRIPTION OF THE DRAWINGS

The accompanying drawings are incorporated into and form a part of the specification to illustrate several examples. These drawings, together with the description, explain the principles of various embodiments of the present disclosure. The drawings simply illustrate preferred and alternative examples of how various embodiments can be made and used and are not to be construed as limiting the claimed subject matter to only the illustrated and described examples.

Figure 1:
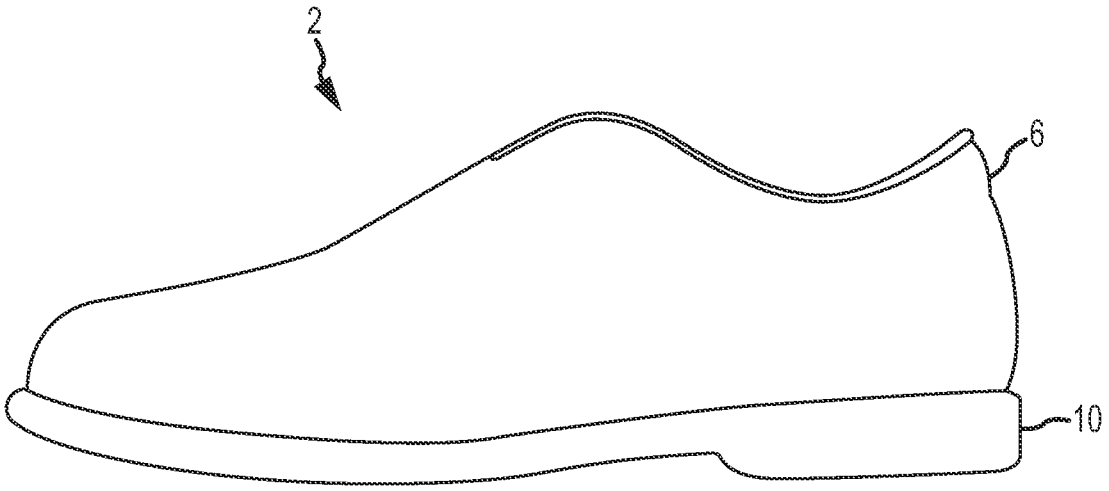
FIG. 1 PRIOR ART
FIG. 1 is a side elevation view of an article of footwear.

Further features and advantages will become apparent from the following, more detailed, description of some embodiments of the disclosure, as illustrated by the drawings referenced below.

DETAILED DESCRIPTION

As used herein, the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

As used herein, the term "longitudinal" refers to a direction extending a length of a footwear component. For example, the longitudinal direction may extend from a heel region of a footwear component to a toe region of the footwear component. Also, as used herein, the term "lateral" refers to a direction extending a width of a footwear component. Further, as used herein, the term "vertical" refers to a direction generally perpendicular to the longitudinal and the lateral direction.

As used herein, the term "proximal" refers to a position that is closer to a portion of a foot when an article of footwear is worn. The term "distal" refers to a position that is further from a portion of a foot when an article of footwear is worn. Each of these directional terms may be applied to individual portions of a footwear component.

As used herein, the term, "fiber" refers to at least one of the following list: single-walled carbon-nanotubes, multi-walled carbon nanotubes, graphene nanoribbons, carbon-fibers, metal fibers, glass fibers, rayon fibers, silk fibers, nylon fibers, olefin fibers, acrylic fibers, polyester fibers, and aramid fibers.

As used herein, the term, "innersole" refers to a removable portion of the sole of an article of footwear, which is inserted into the article of footwear from the opening in the upper and which is designed to provide support to the wearer's foot, depending upon the wearer's anatomy and the intended use of the article of footwear.

As used herein, the term "lug" refers to a protusion either integral to the outsole or attached to the outsole that aids in providing traction for the wearer of an article of footwear.

As used herein, the term, "midsole" refers to that portion of the sole of an article of footwear sandwiched between the innersole and the outsole, to which is attached the outsole.

As used herein, the term, "outsole" refers to that portion of the sole of an article of footwear that is furthest from the upper.

As used herein, the term, "polymeric material," refers to one or more of vinyl esters, epoxies, polyolefins, polystyrenes, polyvinyls, polyacrylics, polyhalo-olefins, polydienes, polyoxides, polyesthers, polyacetals, polysulfides, polythioesters, polyamides, polythioamides, polyurethanes, polythiourethanes, polyureas, polythioureas, polyimides, polythioimides, polyanhydrides, polythianhydrides, polycarbonates, polythiocarbonates, polyimines, polysiloxanes, polysilanes, polyphosphazenes, polyketones, polythioketones, polysulfones, polysulfoxides, polysulfonates, polysulfoamides, polyphylenes, and combinations and/or mixtures thereof.

As used herein, the term, "prepreg layer" refers to a layer of polymeric material that has previously been impregnated with fibers.

As used herein, the term, "resin," refers to a polymeric material that is a homopolymer, copolymer, polymer alloy or a combination thereof. FIG. 1 is a side elevation view of an article of footwear, generally referred to as a shoe 2. As illustrated, the shoe 2 comprises a shoe upper 6 attached to a sole 10. The upper 6 generally encloses the foot and can comprise any upper now known or later developed in the art. The sole 10 may include, but is not limited to, an innersole, a midsole, and/or an outsole.

Figure 2:
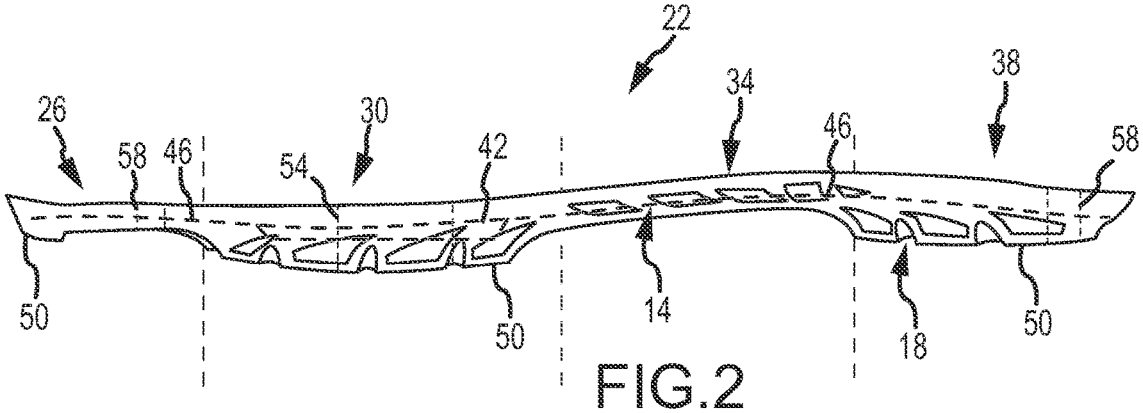
FIG. 2 is a side elevation view of one embodiment of an outsole.
Figure 3:
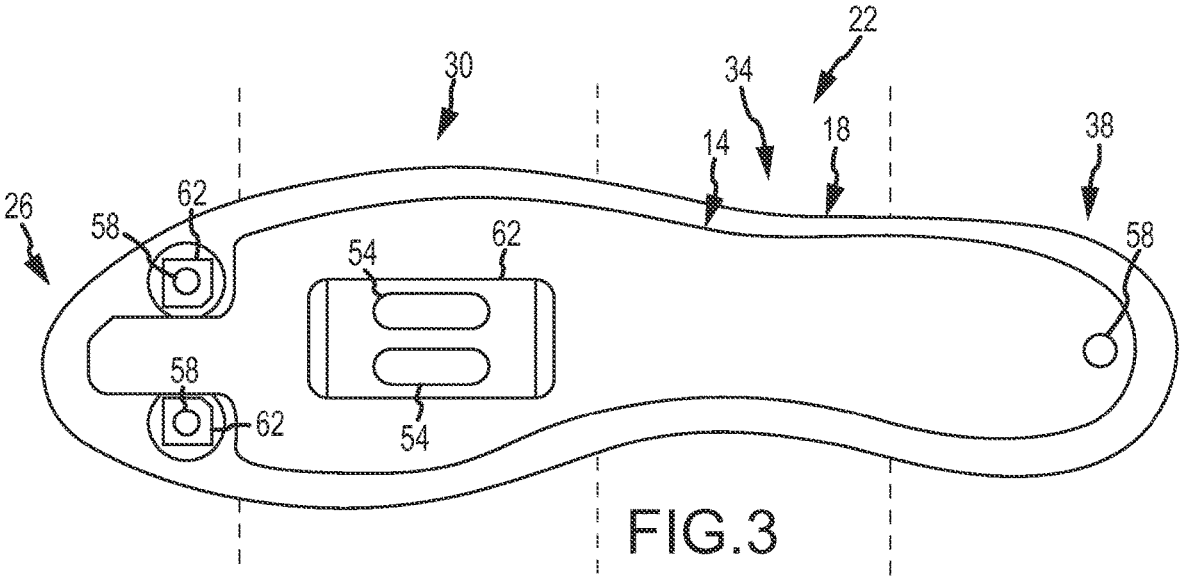
FIG. 3 is a top plan view of the outsole of FIG. 2.
Figure 4:
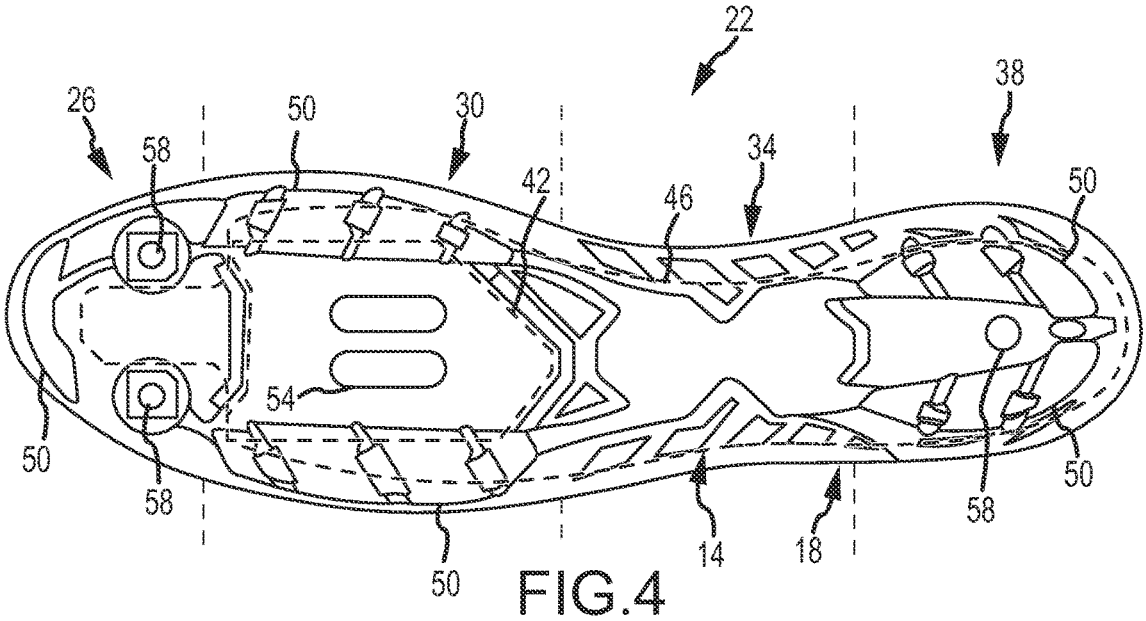
FIG. 4 is a bottom plan view of the outsole of FIG. 2.

FIGS. 2-14 depict specific embodiments of the present invention. FIGS. 2-4 illustrate embodiments of a composite element integrally formed with an outsole element to form an outsole. FIGS. 5-9 illustrate embodiments of a composite element that may be associated with both left and right forms of a sole designed to fit a man, a woman, or both. Embodiments may be associated with soles having a shoe size according to any international shoe size designation. Embodiments may be associated with soles attached to a wide range of athletic footwear, including but not limited to walking shoes, tennis shoes, basketball shoes, cross-training shoes, weightlifting shoes, bicycling shoes, track spikes, soccer shoes, football shoes, roller skates, clap skates and other ice skates, Nordic skiing boots, downhill skiing boots, and snowboard boots, for example. In addition, embodiments may be associated with soles attached to a wide range of non-athletic footwear, including but not limited to work boots, sandals, loafers, and dress shoes. Accordingly, embodiments of the present invention apply to footwear generally. FIGS. 10-13 illustrate embodiments of a fiber-reinforced layer(s) that may be utilized to form a composite element. FIG. 14 illustrates one embodiment of a method of manufacturing a composite element.

Referring now to FIGS. 2-4, embodiments of a composite element 14 joined to an outsole element 18 to form an outsole 22 are provided. As illustrated, the outsole 22 is divided into four general regions: a toe region 26 that generally corresponds with a wearer's toes, a forefoot region 30 that generally corresponds with a wearer's metatarsal bones and the joint between the metatarsal bones and the phalanges, an arch region 34 that generally corresponds with a wearer's foot arch, and a heel region 38 that generally corresponds with a wearer's foot heel. As illustrated, the forefoot region 30 is positioned between the toe region 26 and the arch region 34, and the arch region 34 is positioned between the forefoot region 30 and heel region 38. The depicted regions are not intended to demarcate precise areas of the composite element 14, the outsole element 18, or the outsole 22. Instead, the regions are intended to define general areas that aid in the following discussion.

As illustrated, the composite element 14 and the outsole element 18 have been contoured to generally conform to the shape of a foot. Accordingly, the composite element 14 and/or the outsole element 18 may have a raised arch. Additionally, the composite element 14 and/or the outsole element 18 may have a raised peripheral area that extends around the sides of a foot. Further, the composite element 14 and/or the outsole element 18 may have a depression for receiving a heel. In some embodiments, the composite element 14 may be integrally formed with the outsole element 18, such as in FIGS. 2-4, to provide additional stiffness. In other embodiments, the composite element 14 may be formed as a separate article and connected to the outsole element 18 using known methods of attachment, such as adhesives, molding, stitching, mechanical fasteners, and the like. In addition, the composite element 14 may be connected to the bottom surface of a midsole such that the composite element 14 is visible and, in some instances, accessible from the bottom of the article of footwear.

The composite element 14 shown in FIGS. 2-4 includes portions with different rigidities. For example, the composite element 14 includes a more rigid portion 42 associated with the forefoot region 30 of the composite element 14 and a less rigid portion 46 associated with the toe region 26, the forefoot region 30, the arch region 34, and the heel region 38 of the composite element 14. The more rigid portion 42 can be formed, for example, in various shapes and thicknesses to tune the flexure characteristics of the more rigid portion 42 with the wearer's characteristics and the intended use of the footwear. The depicted more rigid portion 42 is formed in the shape of a shield when viewed from a distal viewpoint. Alternative shapes include, but are not limited to, circular, triangular, rectangular, trapezoidal, and combinations thereof. As shown in FIG. 2, the more rigid portion 42 has a greater thickness than the less rigid portion 46. In FIG. 2, the added thickness generally protrudes distally from the composite element 14. However, in alternative embodiments, the more rigid portion 42 may include a thickness that protrudes proximally from a less rigid portion 46 of the composite element 14 or protrudes proximally and distally from a less rigid portion 46 of the composite element 14. In some embodiments, a more rigid portion 42 may have the same thickness as a less rigid portion 46. In some embodiments, the more rigid portion 42 may be substantially rigid and substantially non-deformable.

In FIGS. 2-4, the size, shape, and thickness of the regions of the composite element 14 in the less rigid portion 46 of the composite element 14 is adjusted to vary the rigidity of the regions. For example, the altered size and shape of the toe region 26 in FIG. 4 provides a different rigidity, including torsional and/or bending, in the toe region 26 as compared to the other regions of the less rigid portion 46 of the composite element 14. In one embodiment, the less rigid portion 46 may be deformable. In another embodiment, the less rigid portion 46 may be deformable by torsional and/or shear stresses.

As illustrated in FIG. 2, the outsole element 18 may contain one or more lugs 50 extending distally from the outsole element 18. The one or more lugs 50 may be an integral component of the outsole element 18, or, alternatively, the one or more lugs 50 may be a separate piece attached to the outsole element 18. Additionally, the position and composition of the one or more lugs 50 may vary depending on the type of footwear that the outsole element 18 will be incorporated into. For example, the one or more lugs 50 may be composed of a polymeric material. Additionally, the polymeric material of the one or more lugs 50 may differ from the polymeric material of the outsole element 18 when the one or more lugs is attached to rather than an integral component of the outsole element 18.

In certain embodiments, the outsole element 18 is a polymeric material, comprising one or more of a homopolymer, copolymer, polymer alloy or a combination thereof, and wherein the polymeric material comprises one or more of vinyl esters, epoxies, polyolefins, polystyrenes, polyvinyls, polyacrylics, polyhalo-olefins, polydienes, polyoxides, polyesthers, polyacetals, polysulfides, polythioesters, polyamides, polythioamides, polyurethanes, polythiourethanes, polyureas, polythioureas, polyimides, polythioimides, polyanhydrides, polythianhydrides, polycarbonates, polythiocarbonates, polyimines, polysiloxanes, polysilanes, polyphosphazenes, polyketones, polythioketones, polysulfones, polysulfoxides, polysulfonates, polysulfoamides, polyphylenes, and combinations and/or mixtures thereof.

The composite element 14 and the outsole element 18 in FIGS. 2-4 can include several cleat attachment voids. For example, in the forefoot region 30 two slots 54 are provided and adapted to accommodate a bicycle pedal cleat. In this configuration, a more rigid portion 42 of the forefoot region provides a stiff interaction point to transfer energy from the outsole 22 to a bicycle pedal. Additionally, a cleat attachment void may be provided in one or both of the toe region 26 and the heel region 38. For example, in FIGS. 2-4, apertures 58 are provided in the toe region 26 and the heel region 38. While the attachment voids are illustrated with reference to a bicycling shoe, it can be appreciated that the location and configuration of one orientation of the attachment voids will vary depending on the type of shoe. For example, a Nordic ski shoe can have a cleat attachment void different from a bicycling shoe. It can be further appreciated that the shoe may not include a cleat attachment void. Additionally, a second plurality of fiber-reinforced layers may be added to the toe and heel region of composite element 14 to provide extra rigidity to the areas surrounding a cleat attachment void.

Further, as depicted in FIG. 3, an outsole 22 may include one or more depressed areas surrounding the proximal side of a cleat attachment void. The illustrated depressed areas 62 surround the slots 54 formed in the forefoot region 30 and the apertures 58 formed in the toe region 26. The depressed area 62 surrounding the slots 54 can be dimensioned to accommodate a bicycling cleat mounting plate, and the depressed area 62 surrounding the apertures 58 can be dimensioned to accommodate mounting plates for other types of cleats.

Figure 5:
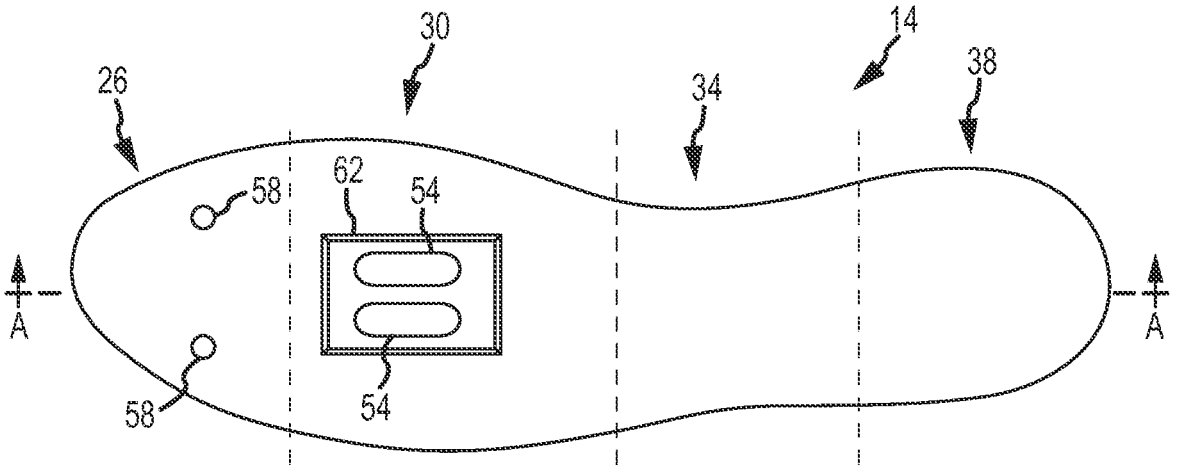
FIG. 5 is a top plan view of one embodiment of a composite element.
Figure 6:
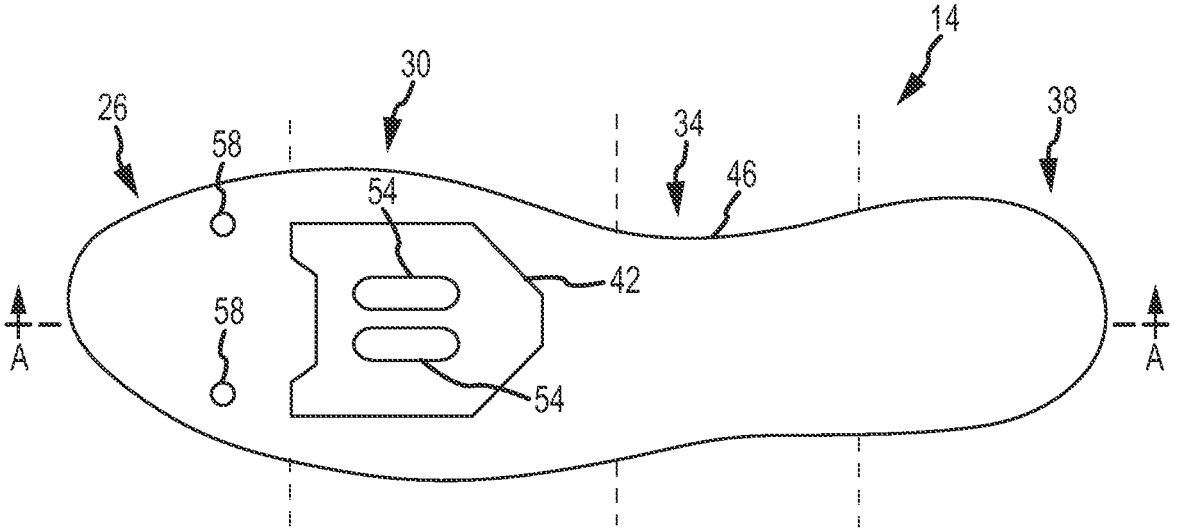
FIG. 6 is a bottom plan view of the composite element of FIG. 5.

Referring now to FIG. 5, a composite element 14 is depicted and divided into four general regions: a toe region 26 that generally corresponds with a wearer's toes, a forefoot region 30 that generally corresponds with a wearer's foot front sole, an arch region 34 that generally corresponds with a wearer's foot arch, and a heel region 38 that generally corresponds with a wearer's foot heel. As illustrated, the forefoot region 30 is positioned between the toe region 26 and the arch region 34, and the arch region 34 is positioned between the forefoot region 30 and the heel region 38. The depicted regions are not intended to demarcate precise areas of the composite element 14.

According to certain embodiments, the composite element 14 may not include all of the indicated regions. Rather, the composite element 14 may include a toe region 26, a forefoot region 30, an arch region 34, or a heel region 38, individually or in any combination thereof. For example, in FIG. 9, the composite element 14 has a toe region 26, a forefoot region 30, and an arch region 34; however, the composite element 14 does not have a heel region 38. Additionally, the regions may vary in size and shape. For example, in FIG. 9, the toe region 26 is shaped in the form of a strip, rather than the typical curve-shape of a toe portion of a sole. Adjusting the size and shape of the various regions varies the rigidity of the regions. For example, the altered size and shape of the toe region 26 in FIG. 9 allows more torsional and/or bending deformation than the toe region 26 and heel region 38 shown in FIG. 5.

Figure 7:
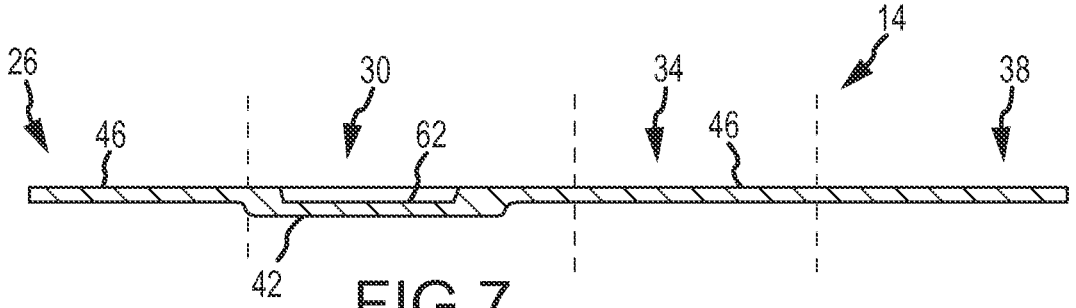
FIG. 7 is a cross-sectional view of the composite element of FIG. 5 taken along line A-A of FIG. 5.
Figure 8:
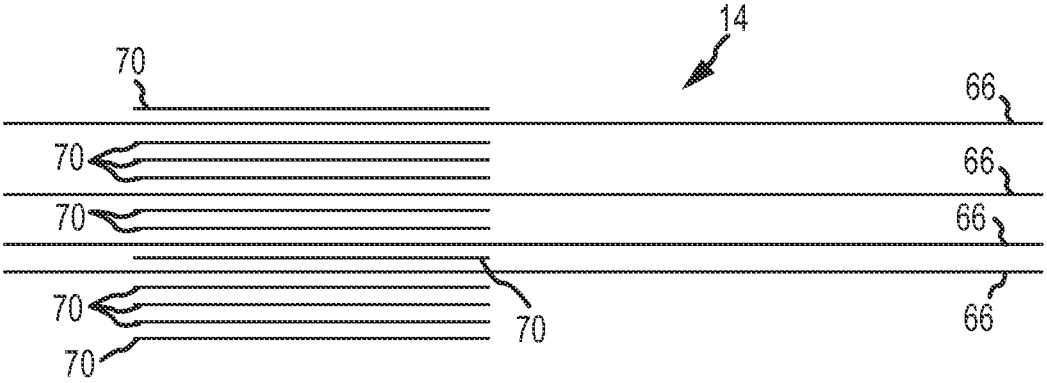
FIG. 8 is an exploded cross-sectional view of the composite element of FIG. 5 taken along line A-A of FIG. 5.
Figure 9:
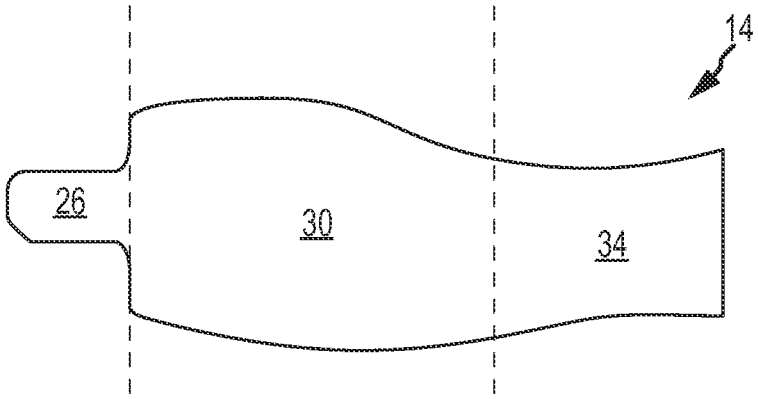
FIG. 9 is a top plan view of another embodiment of a composite element.

FIGS. 7-8 illustrate embodiments of a composite element 14 having a more rigid portion 42, which may be substantially rigid and non-deformable, and at least one less rigid portion 46, which may be deformable. As illustrated, the more rigid portion 42 is positioned in the forefoot region 30, whereas the less rigid portion 46 is positioned in one or more of the toe region 26, the arch region 34, and the heel region 38. In FIG. 8, the less rigid portion 46 is comprised of at least one fiber-reinforced layer 66 in the toe region 26, the arch region 34, and/or the heel region 38. The at least one fiber-reinforced layer 66 of the less rigid portion 46, as depicted in FIG. 8, may be configured to deform in response to normal wear as well as shear and torsional stresses, or any combination thereof. For example, where only moderate lateral, or transverse, loads are encountered, the at least one fiber-reinforced layer 66 of the less rigid portion 46 may have minimal stiffness, thereby increasing the flexibility of the less rigid portion 46 of the composite element 14, as shown in FIG. 8. Alternatively, where large lateral loads are encountered, the at least one fiber-reinforced layer 66 of the less rigid portion 46, as depicted in FIG. 8, may have increased stiffness.

The more rigid portion 42 of the forefoot region 30 may include at least one fiber-reinforced layer 66 and at least one additional fiber-reinforced layer 70 to increase the stiffness of the forefoot region 30, as shown in FIG. 8. The additional stiffness improves energy and/or power transfer. For example, in a bicycling shoe, as in FIG. 7, a more rigid portion 42 may be positioned in the forefoot region 30 to increase energy and/or power transfer from the rider to the pedal. As illustrated, at least one additional fiber-reinforced layer 70 may be interposed with the at least one fiber-reinforced layer 66. In one embodiment, a more rigid portion 42 of the forefoot region 30 provides maximum energy and/or power transfer while the less rigid portion 46 of the toe region 26, the arch region 34, and the heel region 38 provides flexibility. This varying rigidity in various regions of a sole is particularly useful for many athletic and other shoes that need to transfer energy and/or power efficiently and/or need to provide protection and/or comfort to specific areas of a wearer's foot. It can be appreciated that, the number and the stacking configuration, including orientation, of the fiber-reinforced layers 66 and 70, as depicted in FIG. 8, may be altered as desired. For example, the flexure characteristics of composite element 14 may be altered by varying the number of fiber-reinforced layers 66 and 70, the configuration and thickness of each layer 66 and 70, and the orientation of each layer 66 and 70. In this manner, the composite element 14 is adapted to the characteristics of the wearer and the intended use.

In one embodiment, the at least one fiber-reinforced layer 66 has from about one to about four fiber-reinforced layers 66. As discussed above, depending on the configuration, the composite element 14 might not extend to or comprise all regions. Accordingly, in some configurations, the toe region 26, the forefoot region 30, the arch region 34, and the heel region 38, or any combination thereof, will not have a fiber-reinforced layer.

Another factor affecting the flexure characteristics of the composite element 14 is the configuration and thickness of each fiber-reinforced layer. In certain embodiments, each fiber-reinforced layer comprises a resin component and a fiber-containing component. The resin component may include one or more of a homopolymer, copolymer, polymer alloy or a combination thereof, and wherein the polymeric material comprises one or more of vinyl esters, epoxies, polyolefins, polystyrenes, polyvinyls, polyacrylics, polyhalo-olefins, polydienes, polyoxides, polyesthers, polyacetals, polysulfides, polythioesters, polyamides, polythioamides, polyurethanes, polythiourethanes, polyureas, polythioureas, polyimides, polythioimides, polyanhydrides, polythianhydrides, polycarbonates, polythiocarbonates, polyimines, polysiloxanes, polysilanes, polyphosphazenes, polyketones, polythioketones, polysulfones, polysulfoxides, polysulfonates, polysulfoamides, polyphylenes, and combinations and/or mixtures thereof. The fiber-containing component may include single-walled carbon-nanotubes, multi-walled carbon nanotubes, graphene nanoribbons, carbon-fibers, glass fibers, rayon fibers, silk fibers, metal fibers, nylon fibers, olefin fibers, acrylic fibers, polyester fibers, aramid fibers, and combinations thereof.

The fiber-containing component and the resin, alone or together, can determine the final rigidity of the composite. The fiber-containing component may contain fibers that are randomly oriented, unidirectionally oriented, layered, woven, or any combination thereof.

Figure 10:
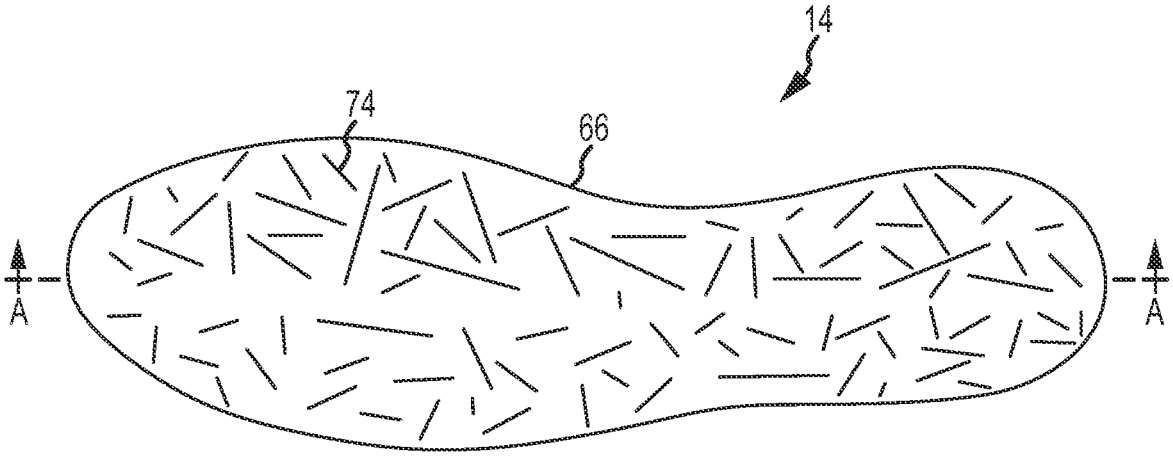
FIG. 10 is a top plan view of one embodiment of a fiber-reinforced layer that may be utilized to form a composite element.

FIG. 10 illustrates one embodiment of a fiber-reinforced layer 66 having a plurality of fibers 74 randomly oriented with respect to a line A-A. The random orientation of the fibers 74 can provide one or both longitudinal and transverse stiffness.

Figure 11:
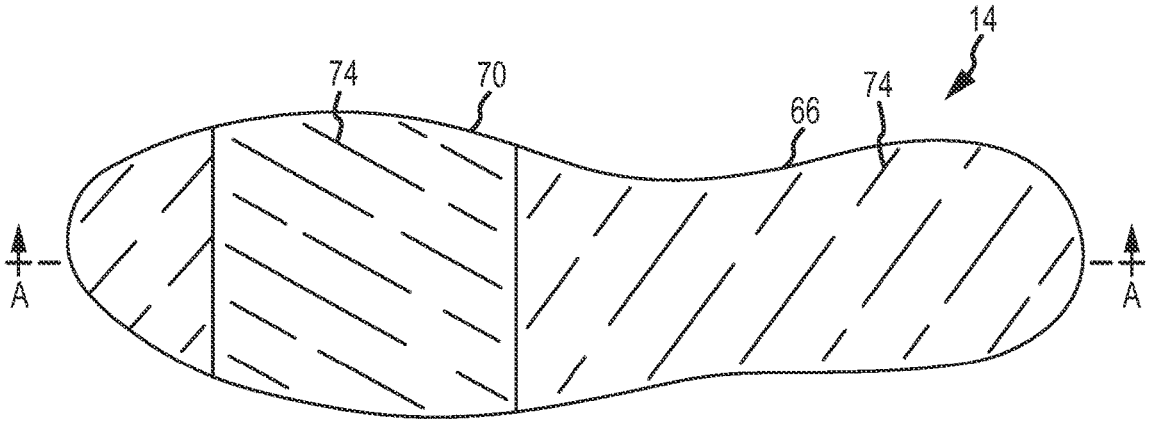
FIG. 11 is a top plan view of one embodiment of a first fiber-reinforced layer associated with a second fiber-reinforced layer that may be utilized to form a composite element.

FIG. 11 illustrates one embodiment of a composite element 14 having at least one fiber-reinforced layer 66 and at least one additional fiber-reinforced layer 70. A plurality of fibers 74 within the at least one fiber-reinforced layer 66 is substantially oriented at a first angle with respect to a longitudinal axis A-A that extends from the toe region to the heel region of the composite element 14. A plurality of fibers 74 within the at least one additional fiber-reinforced layer 70 is substantially oriented at a second, differing angle with respect to the longitudinal axis A-A. By altering the orientation of the reinforcing fibers 74 in different fiber-reinforced layers, each fiber-reinforced layer may have one or both of a different directional flexure characteristic and stiffness. By using multiple fiber reinforced layers, the longitudinal and transverse flexure characteristics of the composite element can be tailored for a specific activity in which the human wearer is expected to engage.

As indicated, the stiffness of a composite element 14 can be tailored to specific applications by varying the number of the fiber-reinforced layers, as well as the angular orientations of the layers. Further, the flexure characteristics of the at least one fiber-reinforced layer 66 and the at least one additional fiber-reinforced layer 70 may customize the localized regional stiffness to accommodate a specific application. The particular flexure characteristic to be incorporated in any given article of footwear may be tuned to the wearer and/or activity the wearer is to be engaged in.

Thus, in one embodiment, a fiber-reinforced layer 66 is oriented at a first predetermined angle with respect to another fiber-reinforced layer 66, and an additional fiber-reinforced layer 70 is oriented at a second predetermined angle with respect to a fiber-reinforced layer 66 and/or another additional fiber-reinforced layer 70. The layer(s) of the at least one fiber-reinforced layer 66 and the at least one additional fiber-reinforced layer 70 can be arranged at various offsets corresponding to rotations relative to the longitudinal axis A-A. For example, in one specific embodiment, the layer(s) of the at least one fiber-reinforced layer 66 is arranged at offsets corresponding to rotations of approximately 10 degrees from the longitudinal axis A-A, and the layer(s) of the at least one additional fiber-reinforced layer 70 is arranged at offsets corresponding to rotations of approximately 45 degrees from the longitudinal axis A-A. Accordingly, the fiber-reinforced layers can provide varying degrees of stiffness or alternatively flexibility in a specific region of a sole. One of skill in the art will appreciate that individual layers 66 and 70 may be oriented from 0 degrees to 180 degrees, in either a clockwise or counterclockwise direction, from the longitudinal axis A-A, depending on the desired flexure characteristics.

Figure 12:
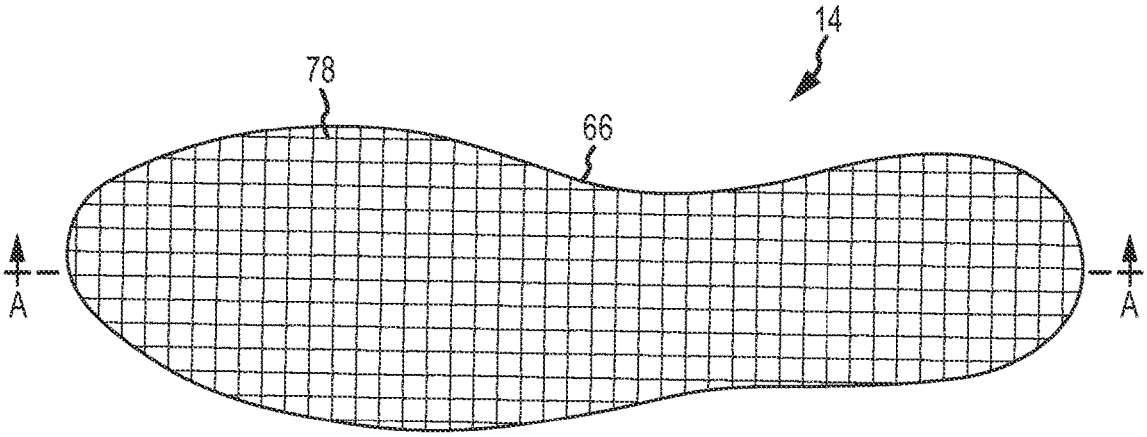
FIG. 12 is a top plan view of one embodiment of a fiber-reinforced layer including a woven fabric that may be utilized to form a composite element.

FIG. 12 illustrates one embodiment of a fiber-reinforced layer 66 employing a woven fabric 78. The alignment and weave of the woven fabric 78 can provide strength and stiffness properties in certain portions of the composite element 14 and flexibility in other portions of the composite element 14. These variations in strength and stiffness between the portions of the composite element may be accomplished by varying the number of layers of fabric within the fiber-reinforced layer(s), or the orientation of the layers of fabric within the fiber-reinforced layer(s). Preferably, the strength and stiffness properties are about the forefoot region 30 and the flexibility is about one or more of the toe region 26, the arch region 34, and the heel region 38. The woven fabric 78 may include at least one fiber selected from single-walled carbon-nanotubes, multi-walled carbon nanotubes, graphene nanoribbons, carbon-fibers, metal fibers, glass fibers, rayon fibers, silk fibers, nylon fibers, olefin fibers, acrylic fibers, polyester fibers, and aramid fibers. The fibers making up the fabric may be adhered to at least one polymeric material. The polymeric material may comprise at least one of a vinyl ester, epoxy, polyolefin, polydiene, polyoxide, polyesther, polyamide, polythioamide, polyurethane, polyimide, polythioimide, polycarbonate, polythiocarbonate, polyketone, and polythioketone.

Figure 13:
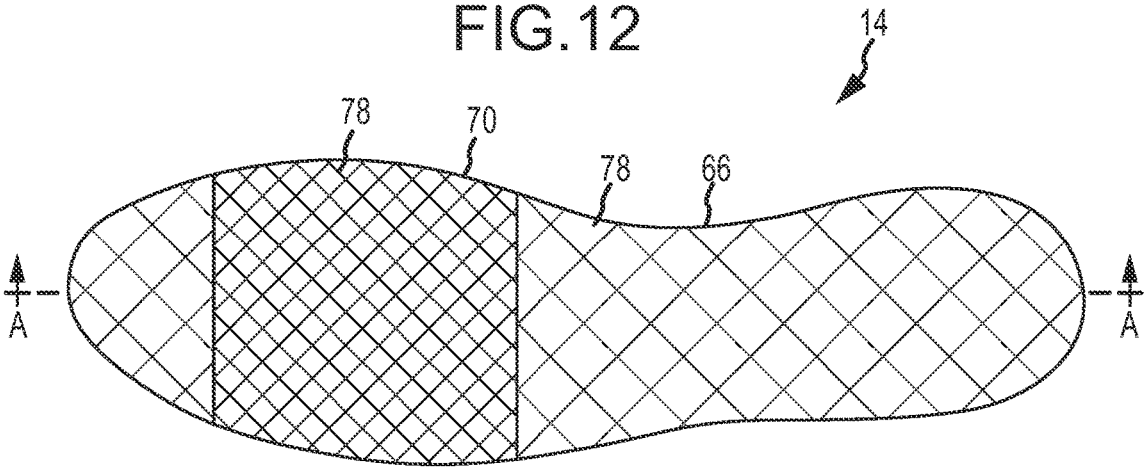
FIG. 13 is a top plan view of one embodiment of a first woven fabric fiber-reinforced layer associated with a second woven fabric fiber-reinforced layer that may be utilized to form a composite element.
Figure 14:
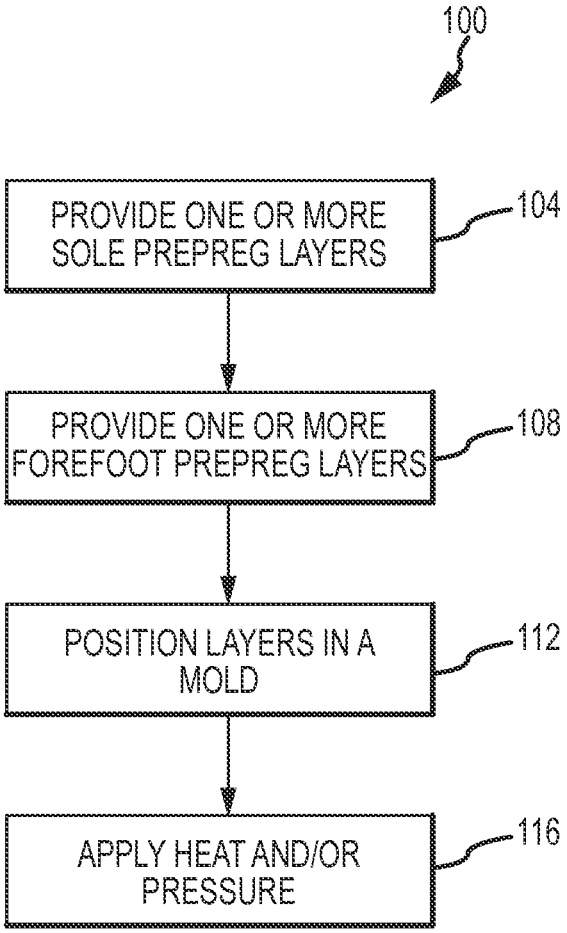
FIG. 14 is a flow diagram of a method of manufacturing a composite element according to one embodiment of the present disclosure.

FIG. 13 illustrates embodiments of a composite element 14 having at least one fiber-reinforced layer 66 and at least one additional fiber-reinforced layer 70. The fiber-reinforced layers may contain a woven fabric 78 having a bias. The woven fabric 78 within the at least one fiber-reinforced layer 66 can be substantially oriented at a first angle with respect to a longitudinal axis A-A. The woven fabric 78 within the at least one additional fiber-reinforced layers 70 can be substantially oriented at a second angle with respect to the longitudinal axis A-A. As discussed above in relation to FIG. 11, the orientation of the woven fabric within a fiber-reinforced layer, the number of fiber-reinforced layers, and the orientation of the fiber-reinforced layers may be adjusted for a particular wearer and intended use. This includes adjusting the relative flexure characteristics of a substantially deformable portion and a substantially non-deformable portion of the composite element 14.

FIG. 14 illustrates a method 100 of forming a composite element 14 according to one embodiment of the present invention. With reference to FIG. 14 and FIGS. 5-8, the method 100 comprises providing one or more sole prepreg layers (step 104) and one or more forefoot prepreg layers (step 108). Each prepreg layer can contain one or more fiber-reinforced layers. Each sole prepreg layer 66 has a forefoot region 30 and optionally at least one of a toe region 26, an arch region 34, and a heel region 38. The forefoot region 30 is positioned between the toe region 26 and the arch region 34, and the arch region 34 is positioned between the forefoot region 30 and heel region 38. At least one sole prepreg layer 66 and at least one forefoot prepreg layer 70 are positioned in a first mold (step 112), one on top of another to form a first assembly having each of the forefoot prepreg layers 70 positioned about the forefoot region 30 of the one or more sole prepreg layers 66. The hierarchy of sole prepreg layers 66 and forefoot prepreg layers 70 may vary. For example, several sole prepreg layers 66 may be stacked on top of each other before adding a forefoot prepreg layer 70 or vice versa. Additionally, several forefoot prepreg layers 70 may be stacked on top of each other before adding a sole prepreg layer 66. Then, heat or pressure, or a combination of both, are applied (step 116) to form a composite element 14, i.e., a laminate composite.

Optionally, the composite element 14 could be molded to an outsole element 18 to form an outsole 22, as depicted, for example, in FIG. 3. Molding processes include cast, injection, reaction injection, compression, transfer, laminate, or combinations thereof. As depicted in FIGS. 2 and 4, for example, one or more lugs 50 may be formed as an integral component of the outsole 18 during the molding step. Alternatively, one or more lugs 50 may be attached to the outsole 22 after the molding step. Additionally, one or more cleat attachment voids 54, 58 may be formed in the outsole 22. Additionally, this method may be used to form a midsole or an innersole.

The present disclosure, in various embodiments, configurations, or aspects, includes components, methods, processes, systems and/or apparatus substantially as depicted and described herein, including various aspects embodiments, configurations, sub-combinations, and subsets thereof. Those of skill in the art will understand how to make and use the various aspects, embodiments, configurations, sub-combinations, and subsets of the present disclosure after understanding the disclosure. The present disclosure, in various aspects, embodiments, and configurations, includes providing devices and processes in the absence of items not depicted and/or described herein or in various aspects, embodiments, or configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more aspects, embodiments, or configurations for the purpose of streamlining the disclosure. The features of the aspects, embodiments, or configurations of the disclosure may be combined in alternate aspects, embodiments, or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, or configuration. Thus, the following claims are hereby incorporated into this Detailed Description, with each claim standing on its own as a separate preferred embodiment.

Moreover, though the description of the disclosure has included description of one or more aspects, embodiments, or configurations and certain variations and modifications, other variations, combinations, and modifications are within the scope of the invention, e.g., as may be within the skill and knowledge of those in the art, after understanding the present disclosure. It is intended to obtain rights which include alternative aspects, embodiments, or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A sole for a cycling shoe, the sole comprising: a toe region, a forefoot region, an arch region, and a heel region, wherein the sole includes two transversely oriented apertures defined in the toe region, wherein the sole comprises a composite plate element that extends between the toe region, the forefoot region and the arch region, wherein the composite plate element comprises at least first and second sole fiber-reinforced layers that extend from the toe region, through the forefoot region and into the arch region, wherein the composite plate element further comprises at least a first forefoot region fiber-reinforced layer positioned in the forefoot region and positioned between the first and second sole fiber-reinforced layers, wherein the first forefoot region fiber-reinforced layer causes the forefoot region to have a higher rigidity than the arch region, wherein the toe region of the composite plate is formed by a strip that extends forwardly from the forefoot region and extends longitudinally between the two transversely oriented apertures, and wherein the first and second sole fiber-reinforced layers and the first forefoot region fiber-reinforced layer comprise a fiber selected from the group consisting of single-walled carbon-nanotubes, multi-walled carbon nanotubes, graphene nanoribbons, carbon-fibers, glass fibers, metal fibers, nylon fibers, and combinations thereof.

2. The sole of claim 1, wherein at least one of the first and second sole fiber-reinforced layers or the first forefoot region fiber-reinforced layer comprise a polymer component selected from the group consisting of a homopolymer, a copolymer, a polymer alloy, and a combination thereof.

3. The sole of claim 1, wherein at least one of the first and second sole fiber-reinforced layers or the first forefoot region fiber-reinforced layer comprise a polymer component selected from the group consisting of vinyl esters, epoxies, polyolefins, polystyrenes, polyvinyls, polyacrylics, polyhalo-olefins, polydienes, polyoxides, polyesthers, polyacetals, polysulfides, polythioesters, polyamides, polythioamides, polyurethanes, polythiourethanes, polyureas, polythioureas, polyimides, polythioimides, polyanhydrides, polythianhydrides, polycarbonates, polythiocarbonates, polyimines, polysiloxanes, polysilanes, polyphosphazenes, polyketones, polythioketones, polysulfones, polysulfoxides, polysulfonates, polysulfoamides, polyphylenes, and a combination thereof.

4. The sole of claim 1, wherein the first forefoot region fiber-reinforced layer is at least as thick as the first and second sole fiber-reinforced layers.

5. The sole of claim 1, wherein the composite plate element further comprises 1 to 4 of the sole fiber-reinforced layers and 1 to 11 of the forefoot region fiber-reinforced layers interposed with the sole fiber-reinforced layers.

6. The sole of claim 1, wherein the first and second sole fiber-reinforced layers have a different thickness than the forefoot region fiber-reinforced layer.

7. The sole of claim 1, wherein the composite plate element has a top surface and a bottom surface, wherein a thickness is defined between the top surface and the bottom surface, and wherein the forefoot region of the composite plate element has a thickness that is greater than the arch region of the composite plate element.

8. The sole of claim 1, wherein the first sole fiber-reinforced layer comprises a material that is more pliable than the second sole fiber-reinforced layer and the first arch region fiber-reinforced layer.

9. The sole of claim 1, wherein the first and second sole fiber-reinforced layers and the first forefoot region fiber-reinforced layer comprise fibers oriented at an angle between 0 degrees and 180 degrees to an axis.

10. The sole of claim 1, wherein at least one of the first and second sole fiber-reinforced layers and the first forefoot region fiber-reinforced layer comprises randomly oriented fibers.

11. The sole of claim 1 formed as an outsole of a cycling shoe.

12. The sole of claim 1 formed as a midsole of a cycling shoe.

13. The sole of claim 1 formed as an innersole of a cycling shoe.

14. The sole of claim 1 wherein the first and second forefoot and arch region fiber-reinforced layers and the first arch region fiber-reinforced layer are molded together to form the composite plate element.

15. A sole for a cycling shoe, the sole comprising:

a toe region having two transversely oriented apertures defined therein, a forefoot region, an arch region, a heel region, an outsole element, and a composite plate element having a top surface, a bottom surface and an outer peripheral edge, wherein the outsole element at least partially surrounds the composite plate element such that the outsole element covers the outer peripheral edge and the bottom surface of the composite plate element, wherein the outsole element has a cleat attachment void defined therethrough to expose the bottom surface of the composite plate element, wherein the composite plate element comprises at least one fiber-reinforced layer that is positioned only in the forefoot region and at least one fiber-reinforced layer that extends from the toe region, through the forefoot region and into the arch region to form toe region, forefoot region and arch region portions of the composite plate element, wherein the forefoot region has a higher rigidity than the arch region and the toe region, wherein the toe region portion of the composite plate element is formed by a strip that extends forwardly from the forefoot region portion and extends longitudinally between the two transversely oriented apertures, and wherein the at least one fiber-reinforced layer that is positioned only in the forefoot region and the at least one fiber-reinforced layer that extends from the toe region, through the forefoot region and into the arch region comprise a fiber selected from the group consisting of single-walled carbon-nanotubes, multi-walled carbon nanotubes, graphene nanoribbons, carbon-fibers, glass fibers, metal fibers, nylon fibers, and combinations thereof.

16. The sole of claim 15 wherein the composite plate element comprises a plurality of fiber-reinforced layers positioned only in the forefoot region and a plurality of fiber-reinforced layers that extend from the toe region, through the forefoot region and into the arch region.

17. The sole of claim 15 wherein the fiber-reinforced layers are molded together to form the composite plate element.

18. The sole of claim 1 wherein the first forefoot region fiber-reinforced layer is positioned under a ball of a user's foot when worn by a user.

* * * * *